US005168684A

United States Patent [19]

Bruhm

[11] Patent Number: 5,168,684

[45] Date of Patent: Dec. 8, 1992

[54] MEANS FOR SECURING ELASTOMERIC SHEATHING TO A ROOF SURFACE

[76] Inventor: Ronald Bruhm, 707 Arrow Rd., Weston Ontario, Canada

[21] Appl. No.: 706,351

[22] Filed: May 28, 1991

[51] Int. Cl.[5] ..... E04D 3/36; F16J 15/10

[52] U.S. Cl. ..... 52/410; 411/542

[58] Field of Search ..... 52/410, 512; 411/542, 411/133-135, 149, 150, 377, 431, 545

[56] References Cited

U.S. PATENT DOCUMENTS

| | | | |
|---|---|---|---|
| 629,699 | 7/1899 | McQueen | 411/545 |
| 4,034,788 | 7/1977 | Melone | 411/134 |
| 4,757,661 | 7/1988 | Hasan | 52/410 |
| 4,799,845 | 1/1989 | Hrysko | 52/410 |
| 5,018,329 | 5/1991 | Hasan et al. | 411/542 |

*Primary Examiner*—James L. Ridgill, Jr.
*Attorney, Agent, or Firm*—K. Maxwell Hill

[57] ABSTRACT

A pair of plates are interposed between the head of a screw means fastened through a roof covering and into a roof surface and truss therebelow. One plate is a lock nut composed of ratchet toothed means fixed to and facing downwards of the screw head and the second plate is a disc-shaped member fixed to the sheath of the roof covering and has ratchet teeth facing upwards and engageable with the teeth of the screw lock nut member when the screw is mated with the disc-shaped member.

2 Claims, 2 Drawing Sheets

MEANS FOR SECURING ELASTOMERIC SHEATHING TO A ROOF SURFACE

BACKGROUND OF THE INVENTION

1. Field of the Invention

The present invention relates to a novel means and method of locking a screw member in position to a roof rafter or truss and there adapted to hold a roof covering therebetween. The screw threads are prevented from unfastening from the action of movement of the held down covering caused by wind action. In particular the invention provides the screw member with a ratched-toothed lock nut that will interlock with the ratchet teeth of a plate that is fixed to the roof and the roof covering thereby preventing unthreading of the screw when wind action causes the covering to lift and flap.

2. Description of the Prior Art

It is known to cover flat roofs with layers of tar and roofing paper and then cover the whole combination with gravel or crushed stone to ballast the covering from shifting and lifting from the action of the wind. During installation the tar has an offensive odor and the stone objectionalbe to handle and when the covering is removed an undesirable mess is caused. There is a need for a better means of covering a roof. As a response to the need roofers have turned to heavy sheets of elastomeric material such as rubber for use as roof covering. The sheets are overlapped and glued together along their mating edges with screw members fixing the sheets to the roof rafters or trusses of the roof. No stone ballast is required to hold down the rubber but when the pressure of a wind causes the covering to tend to lift the screws will unthread and loosen. There has been found that with this new type of roof covering a better means for securing the covering in place has been required.

OBJECTS OF THE INVENTION

The principal object of the invention is to provide an elastomeric roof covering with fastening means that will not work loose during wind and air pressure action caused to the sheets of fixed roof coverings. Another object of the invention is to provide a cap means to the screw member head which will prevent dirt and moisture from accumulating about the screw head and ratchet plates of the fastening means.

SUMMARY OF THE INVENTION

A pair of plates are interposed between the head of a set screw and the covered roof surface. One plate is a lock nut composed of ratchet toothed means fixed to and facing downwards of the screw head and the second plate is a disc-like member fixed to the sheath covering the roof and has ratchet teeth facing upwards and engageable with the ratchet teeth of the screw when the plates are mated together. The teeth are made to mate in such a manner that when the screw has been fixed into the roof surface they will not unwind but can only be ratcheted tighter thereby preventing the screw threads from undoing from its fastening in the roof surface. A dust cover is placed over the head of the screw to prevent dirt from clogging the slot of the screw head thereby allowing the screw to be tightened into the roof should, by any chance, the threads of the screw be loosened by the friction wear action of wind and air lift on the rubber sheath covering material held by the device described herein.

BRIEF DESCRIPTION OF THE DRAWINGS

With the foregoing objects in view and such advantages and novel features as may become apparent from consideration of this disclosure and specification the present invention consists of the concept which is comprised, embodied, and embraced and included in the use, construction and arrangement of parts or any new use of the same herein exemplified in the specific embodiment of the concept, reference being had to the accompanying drawings wherein like reference numerals refer to like parts.

DESCRIPTION OF THE PREFERRED EMBODIMENT OF THE INVENTION

Figure 1:
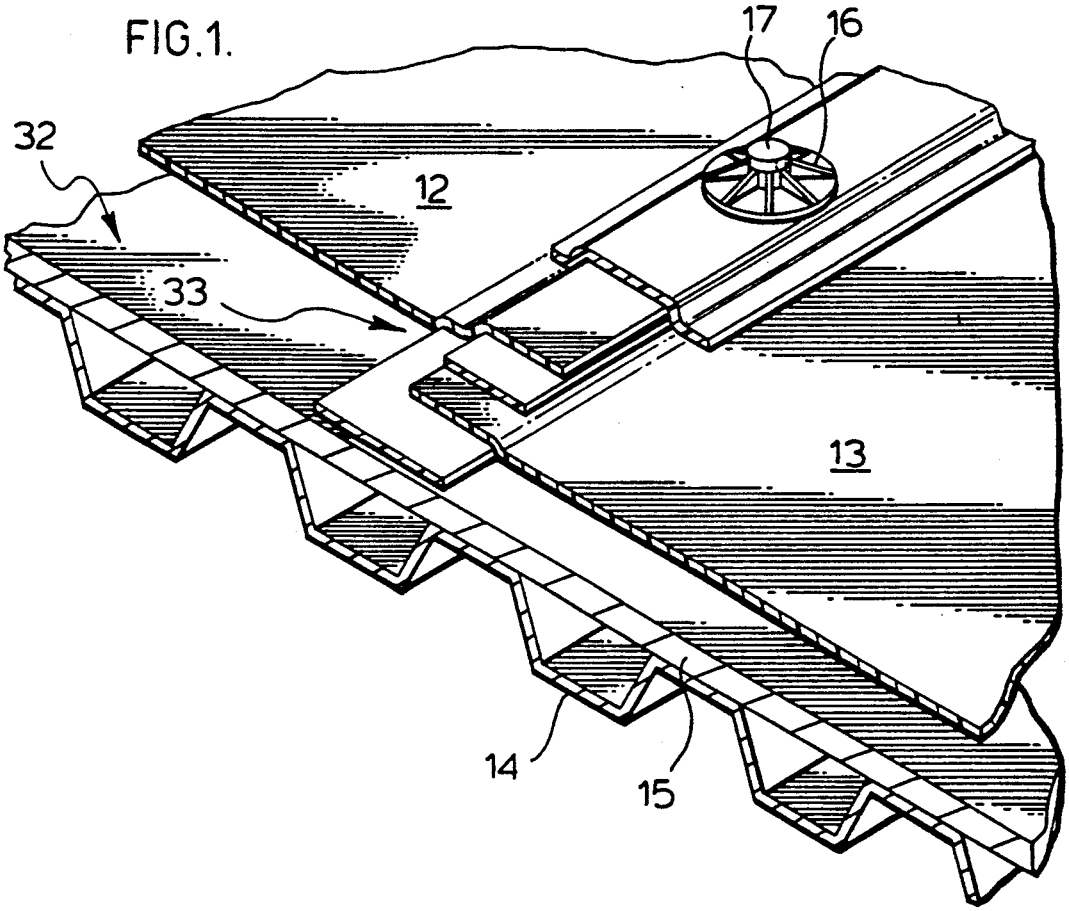

FIG. 1 shows a sectional representation of the end of a flat truss roof with a pair of overlapping sheets of rubber roofing held down by the invention described herein.

Figure 2:
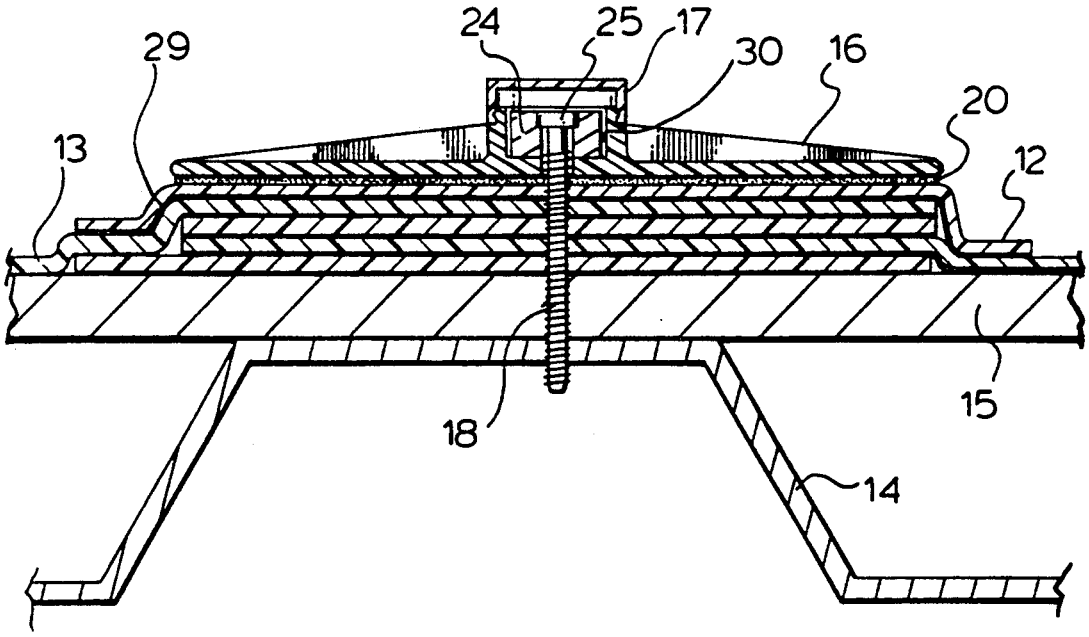

FIG. 2 is a sectional view of the screw and cap and plate shown fixed to a tuss and through a pair of sheet rubber coverings and through a roof structure.

Figure 3:
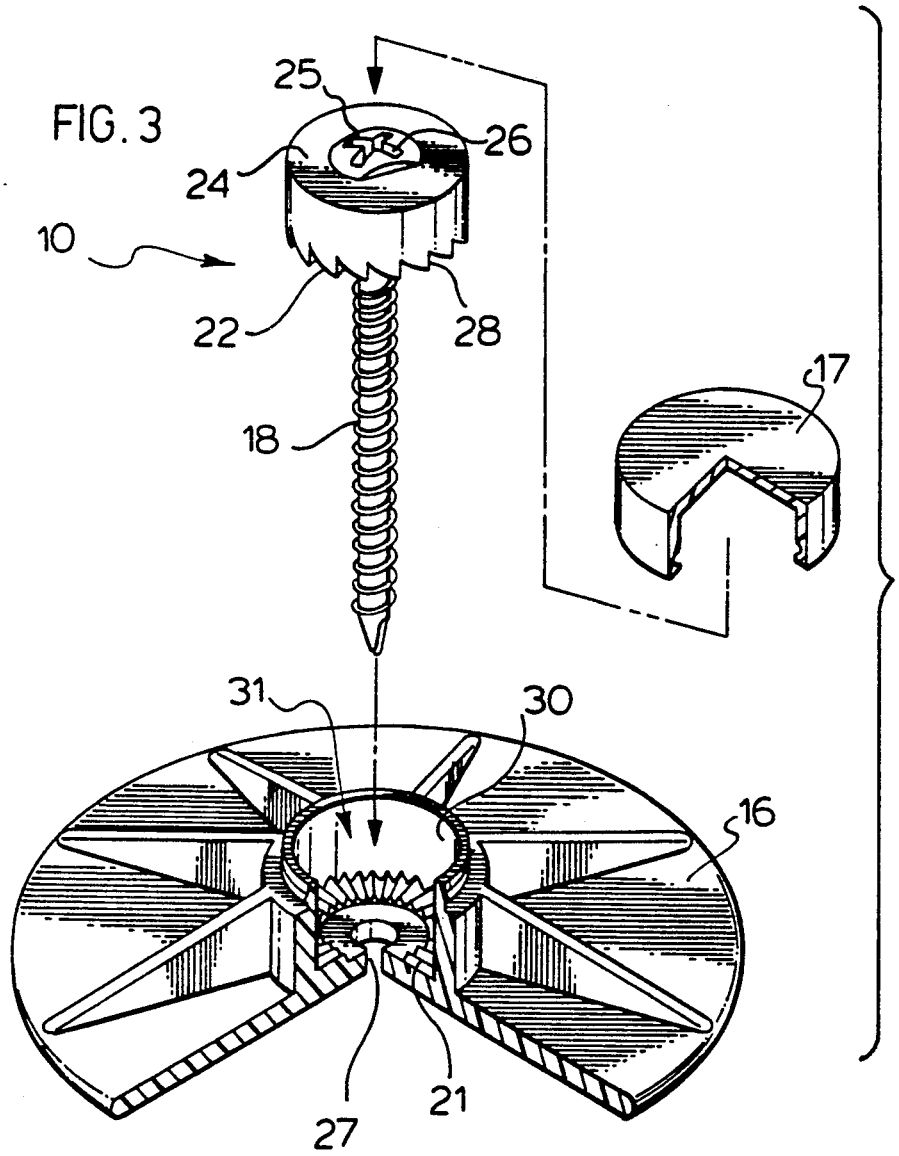

FIG. 3 is a perspective exploded view of the screw, cap, and ratchet plate of the invention.

In FIG. 1 the numeral 15 is a roof decking and 14 is a truss for a flat roof covered by the new type of covering namely rubber sheathing 12, 13 which are shown overlapping and held together by a disc shaped plate 16.

In FIG. 2 the plate 16 shown in cross section is fastened to the rubber sheet 12 by suitable adhesive 20 and has an open central cavity 31 created by wall 30 into which a screw 18 and ratchet toothed upper disc 24 mates and interfits. The screw 18 and disc 24 are combined together as an assembly 10 which can be made in one piece. An aperture 27 is centrally located in the cavity 31 of the disc 16 to receive the shank of the screw 18 which will pass through to be threadably fastenable to and into the deck 15 and the truss 14 of the roof 32. Suitable adhesive 29 can also be applied between the layers of rubber roofing which comprises the roof surface attached by the novel means herein described. A dust cap 17 is fitted over the upstanding wall 30 of the disc 16 and covers the screw head 25 which has been fastened down into the truss 14 to become flush with the said wall top 30.

A set of teeth 22 are formed in the upper disc to face downwards and a set of teeth 21 are formed in the bottom of the cavity 31 of the lower disc plate 16 and face upwards to mate with the teeth 22 of the screw when the screw is inset into the aperture 27 of the disc 16 in direction of the arrow of FIG. 3. The meshing and mating of the teeth 22, 21 creates a ratchet which when engaged allows the screw to be turned into the fastening position with the roof but which will prevent the screw from unfastening due to the vertical saw tooth configuration of one side of the teeth. The slot of the screw head 26 can be of square or star shaped and the cover 17 can be fitted to the wall 30 of the disc 16 to prevent dirt entering the slot 26 and thereby allowing the screw to be reset into the truss and roof should any loosening occur to the device after installation. The screw head 25 is fixed to the upper disc 24 and where the installation is required to be permanent the ratchet can be made fixed by gluing the teeth 22, 21 together during installation.

Mode of use

The sheating 12, 13 is first laid over the roof 32 and glued at the overlapping seam 33 then a plurality of discs 16 are glued along the seam and the screws fitted to the truss through discs 16.

What I claim is:

1. A means for securing roof sheathing to a surface comprising in combination;

a screw member adapted to be threadably fastenable to a truss member or board member of which said surface is constructed;

a pair of plates interposed between said roof sheathing and said screw; each of said plates having opening cavities therethrough for receiving the shank of said screw;

one of said pair of plates is a lock nut adapted to interfit over the shank of said screw and has tooth members facing downwards of the screw head, said lock nut plate being fixed to said screw head;

the second of said pair of plates is a disc having a cavity therein adapted to receive the shank of said screw therethrough and has a flat surface fixable to the flat surface of the roof sheathing by adhesive material;

the second pair of plates has upwardly facing tooth members which will mesh with the teeth of the lock nut plate to create a ratchet means as the screw member is threadably forced into position in the roof surface and will resist unfastening of the screw threads from the roof surface by their ratchet action.

2. A means for securing roof sheathing to a surface as in claim 1 wherein a dust cover is interfitted over the head of the screw.

* * * * *